United States Patent [19]

Lutwick et al.

[11] Patent Number: 4,806,019

[45] Date of Patent: Feb. 21, 1989

[54] METHOD AND APPARATUS FOR MIXING TWO OR MORE COMPONENTS SUCH AS IMMISCIBLE LIQUIDS

[75] Inventors: Gerald D. Lutwick; James D. MacAulay, both of Dartmouth, Canada

[73] Assignee: Nova Scotia Research Foundation Corporation, Dartmouth, Canada

[21] Appl. No.: 91,979

[22] Filed: Sep. 1, 1987

Related U.S. Application Data

[63] Continuation-in-part of Ser. No. 771,606, Sep. 3, 1985, abandoned.

[51] Int. Cl.[4] ..... B01F 9/10; B01F 15/02

[52] U.S. Cl. ..... 366/167; 494/29

[58] Field of Search ..... 366/150, 154, 155, 169, 366/168, 170, 167, 180, 175, 348, 289, 78, 241, 332, 157, 176; 494/27, 29, 31, 44, 53, 54

[56] References Cited

U.S. PATENT DOCUMENTS

| | | | |
|---|---|---|---|
| 2,100,118 | 11/1937 | Andrews | 494/13 |
| 2,917,230 | 12/1959 | Kaldewey | 494/27 |
| 2,921,969 | 1/1960 | Loy | 494/13 |
| 3,328,002 | 6/1967 | Taylor | 366/170 |
| 3,682,447 | 8/1972 | Zucker | 366/157 |
| 3,788,609 | 1/1974 | Toczski | 366/289 |
| 3,885,734 | 5/1975 | Lee | 494/53 |

*Primary Examiner*—Robert W. Jenkins

[57] ABSTRACT

Method and apparatus is disclosed for mixing two or more materials normally considered difficult to evenly and homogeneously intermix such as, for example, viscous fluids. The apparatus is also effectively usable to entrain a gas in a liquid and for ceramic particle formation. The mixing portion of the apparatus includes a mixing chamber in the form of a narrow gap between two walls movable relative to one another. The mixing chamber has individual inlets thereto at one end thereof for individually introducing the different elements to be mixed therein and an outlet at the opposite end for discharge therefrom of the mixed elements. The mixing chamber is preferably an annular chamber in the form of a truncated cone and defined by spaced apart walls, one of which is movable relative to the other by rotation. The distance between the walls defining the mixing chamber is preferably selectively adjustable. The process is continuous with inflow of the materials to be mixed into one end of the mixing chamber and outflow of the mixed materials from the other. The apparatus may also include a centrifugal separator, in which case it circumscribes and is axially coextensive with the mixing chamber. The materials to be mixed may be forced through by pump means and/or force of gravity and/or appropriately shaped formations on one or the other or both of the walls of the mixing chamber.

29 Claims, 3 Drawing Sheets

METHOD AND APPARATUS FOR MIXING TWO OR MORE COMPONENTS SUCH AS IMMISCIBLE LIQUIDS

RELATED APPLICATION

This is a continuation-in-part of application Ser. No. 771,606, filed Sept. 3, 1985, now abandoned.

FIELD OF THE INVENTION

This invention relates to a method and apparatus for mixing two or more materials or mediums normally considered difficult to intermix such as, for example, immiscible viscous fluids, to a unit consisting of such mixing apparatus in combination with a centrifugal separator. The invention is directed mainly to a method and apparatus for mixing immiscible liquids containing reactants and separating the products after reaction, but the mixing portion of the apparatus is also particularly adapted for use in entraining a gas in a liquid or in the formation of ceramic particles. This invention is particularly applicable where intimate mixing of viscose liquids is required and which is difficult by conventional methods and where intimate mixing of liquids containing reactants promotes the extent of reaction.

The mixer of the present invention has utility in numerous different areas of technology that require preparing intimate mixtures of immiscible liquids, for example, preparing coal-water mixtures, coal-oil-water mixtures, mixtures of aliphatic and aromatic compounds contacting two or more reagents and the like. Also, as mentioned above, the mixer portion can be used for entraining a gas in a liquid or for forming particles to a specific size. The combination of the mixer and separator also has numerous areas of application, for example, extraction of metals from solution, separation of aliphatic aromatic compounds in reformate solutions, separation of acids from fish and vegetable oils and removal of contaminants from plant effluents.

PRIOR ART

In known liquid-liquid extractors, contacting and separation of the liquids is performed in the same vessel. The act of separating the liquids is caused by a centrifugal field and the differences in the various type of extractors is the means utilized for contacting the two or more liquids.

Liquid-liquid countercurrent extraction is employed in what is know as the Podbialnaiak centrifugal extractor. The centrifuge contains concentric cylinders slotted at 180° intervals. Light liquid, introduced at the periphery of the rotor, is displaced inward by heavy liquid flowing outward from the axis. In passing through the rotor both phases form new interfacial area at which extraction takes place.

Other known extractors are the Westphalia, Delaval and Quadronic, all of which are similar to the foregoing each differing from the other by the method of contacting.

U.S. Pat. No. 2,921,969 issued Jan. 19, 1960 to J. W. Roy and U.S. Pat. No. 2,100,118 issued Nov. 23, 1937 to N. R. Andrews teach how to separate solids from liquids by means of centrifuges. There is, however, no mixing provision in these machines. Both patented devices employ similar means of connection between the centrifuge proper and the collection chambers. In each, the centrifugal action of rotation throws the separated products from the centrifuge rims into the collection chambers which are stationary. Methods of delivery or more than one liquid into the centrifuge are shown in these patents as well as in U.S. Pat. No. 2,917,230 issued Dec. 15, 1959 to F. Kaldewey. The delivery system in U.S. Pat. No. 2,921,969 employs a "Y" configuration of delivery tubes one arm of which feeds through the centre conduit of the centrifuge and is dispersed into the separating chamber at the bottom. U.S. Pat. No. 2,917,230 discloses two concentric pipes delivering liquid to two different sections of the centrifuge, one liquid going to the separating section of the centrifuge, the other liquid to the periphery of the bowl. In U.S. Pat. No. 2,100,118 the main feed is through the centre of the centrifuge. Provision is made to add two other fluids by delivery tubes extending into separated chamber slots in the centrifuge body. These fluids are carried into the separating chamber by means of channels and, as in the other patents, there is no provision made for mixing.

SUMMARY OF THE INVENTION

An object of the present invention is to provide an effective method and apparatus for mixing immiscible liquids.

Another object of the present invention is to provide an effective method and means of contacting two or more reagents and separating the resultant products.

A further object of the present invention is to provide mixing and separating apparatus wherein there is a short mixing and separating time which allows handling of labile products.

A still further object of the present invention is to provide means of rapidly separating liquids and handling of large volumes.

Another principal object of the present invention is to provide a mixer of simple construction that is useful in mixing differing mediums, such as entraining a gas in a liquid, as well as intermixing different liquids.

The mixing aspect of the present invention comprises introducing immiscible liquids into a narrow space defined by two spaced apart wall surfaces and moving one of the wall surfaces relative to the other to effect mixing of the liquids located between such walls. The process is continuous in that during inflow of the immiscible liquids into the space there is outflow of the mixed liquids from such space. The mixer is primarily used for contacting reagents which occurs in a relatively narrow space and thus may be referred to as a thin film reactor. A major advantage of the mixer is the intimate mixing of the components and short mixing time required.

In a further aspect of the invention the mixture is transferred from the mixer to a separator, preferably a centrifuge, and separated. As will be seen hereinafter, the thin film reactor and separator is a single unit and provides a continuous process. The present invention provides continuous extraction of metals and the separation of organic compounds. A further advantage of the invention is the rapid transit of mixed liquors to the periphery of the centrifugal separator where maximum force is applied separating the liquors. A still further advantage of the invention is the short mixing and separating time which allows handling of labile products. The invention also provides a means of rapidly separating liquids and handling of large volumes.

In accordance with another aspect of the present invention there is provided apparatus for mixing two or more components comprising an annular elongate chamber having a central axis and including respective first and second surface spaced apart from one another, one of said wall surfaces being movable relative to the other by rotation about an axis, passage means for introducing the liquids to be mixed individually into said chamber adjacent one end thereof and means permitting discharging the mixed liquids from adjacent an opposite end thereof.

In accordance with a further aspect there is provided the foregoing mixer in combination with a centrifugal separator.

In accordance with a still further aspect, the mixer and separator are an integral unit with the centrifugal separator having a chamber that circumscribes the chamber of the mixer.

LIST OF DRAWINGS

The invention is illustrated by way of example in the accompanying drawings wherein:

FIG. 3 is a vertical cross-sectional view of the essential components of a mixer of modified design.

Figure 1:
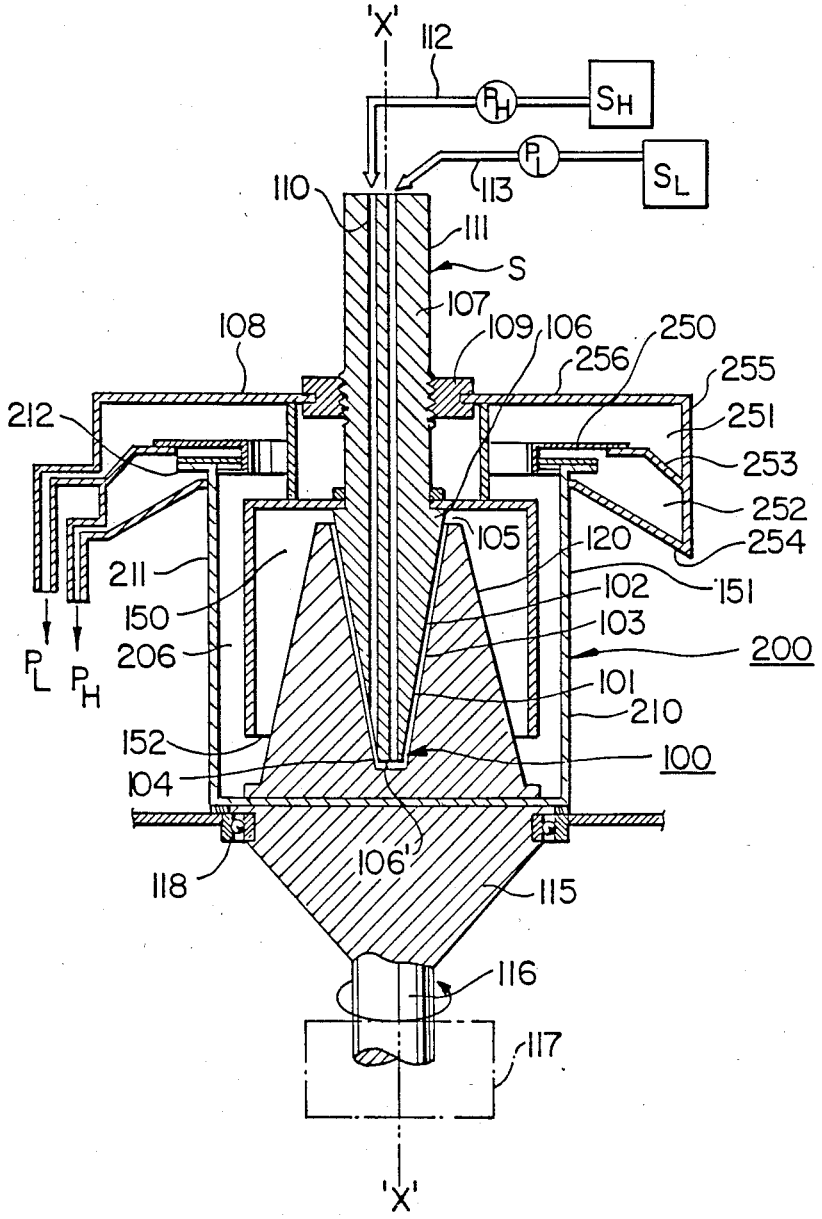
FIG. 1 is a vertical sectional view of a combined mixer and centrifugal separator provided in accordance with the present invention.

Referring to FIG. 1, there is illustrated, in partial diagrammatic and sectional view, a combined mixer and separator provided in accordance with the invention termed herein a thin film reactor, or, simply a reactor. The reactor comprises a mixer designated generally by the reference numeral 100 and a centrigual separator designated generally by the reference numeral 200.

The mixer 100 has an elongate tapered annular mixing chamber 101, defined by respective spaced apart walls 102 and 103, which are movable relative to one another. They are relatively movable in two respects, one being to selectively adjustably vary the space between the walls and the other is by rotating one relative to the other about an axis of rotation. The chamber 101 has an inlet end, designated generally by the reference numeral 104 for the introduction of liquids to be mixed and an outlet end 105 for the discharge of the mixed liquids from the mixing chamber. The wall 102 of the mixer is the outer surface of a conical head 106 on the end of a post 107 adjustably movable on a stationary frame or housing structure 108 by way of, for example, a rotatable but captured nut 109 threaded on the post 107. Rotation of the nut 109 causes the post 107 to move upwardly or downwardly as viewed in FIG. 1 for the purpose which will become apparent hereinafter. A pair of fluid passageways, designated respectively 110 and 111, pass through the post 107 and head 106 opening into the chamber 100 at the inlet end 104 thereof, discharge from passage 111 being at a flattened end portion 106' of the conical head and discharge from passage 110 being in the tapered wall 102.

Liquids to be mixed are fed by way of gravity and/or pumps designated $P_H$ and $P_L$ from liquid supplies $S_H$ and $S_L$ by way of conduits 112 and 113 to respective passages 110 and 111. In the case where the liquids to be mixed differ in viscosity, the heavier liquid would normally be introduced by way of passage 110 into the mixing chamber and the higher liquid by way of passage 111. With reference to the direction of fluid flow, the heavier liquid is introduced into the mixing chamber downstream of the lighter liquid. While this may be desirable, particularly in some instances, it is not necessary and if desired both can enter the mixing chamber at the same flow stream location. For example, both passages can have the outlets therefrom in the flattened head portion 106' or the tapered wall 102 or both.

In the embodiment illustrated in FIG. 1, the post 107, and tapered head 106 on the end thereof, is stationary relative to the support housing structure 108 except for the previously mentioned selective vertical adjustment by way of the rotatable nut 109. This adjustment is used to selectively vary the spacing between walls 102 and 103 defining the mixing chamber. Adjustment of the post obviously can be provided by other suitable means.

Wall 103 of the mixer is provided by a conically shaped cavity in the end of a head member 115 secured to the end of shaft 116 driven for rotation by any suitable power means designated 117. The head 115 is journaled for rotation on the housing structure 108 by suitable bearing means 118.

From the foregoing it is believed clear the mixing chamber 101 is an annular truncated conically shaped chamber the size of which is determined by the distance between walls 102 and 103. The distance between these walls can be increased by moving the post 107 upwardly as viewed in FIG. 1 by the rotatable nut 109 or decreased by movement in the opposite direction. The liquids to be mixed are caused to flow into the inlet end 104 of the chamber by any suitable means, such liquids becoming a thin film between the walls 102 and 103 and mixed by moving one wall relative to the other. In the embodiment shown in FIG. 1, wall 103 is rotated about wall 102 such walls being disposed coaxially about an axis designated X—X. Eccentricity could be tolerated and in some instances may be desirable to enhance mixing.

Walls 102 and 103 are illustrated parallel to one another but if desired this can be modified so as not to be parallel. For example, the distance between such walls may be greater at the inlet end of the mixer than the outlet end particularly with the tapered annular chamber. As a further variation, the annular chamber may be of constant diameter throughout its length or a portion thereof.

The head member 115 has an outer truncated conical wall surface 120 disposed coaxially about the mixing chamber 101 and spaced radially outwardly therefrom and axially substantially coextensive.

An inverted cup-shaped deflector member 151, mounted on the casing structure 108, extends around the truncated conically shaped portion of the head member 105 in radially spaced relation therewith providing therebetween a second annular chamber 150. Mixed liquids flow from the mixing chamber 101 by way of the outlet 105 into the chamber 150. To a certain extent some further mixing of the liquid will occur during through-flow of the liquid in chamber 150. The mixed liquids flow out of chamber 150 by way of outlet 152 which is a gap between the end of the deflector wall 151 and the conical wall 120.

The combined mixer and separator illustrated in FIG. 1 has a separating chamber 206 surrounding and spaced from chamber 150 by the deflector wall 151. The separating chamber 206 is defined by the deflector wall 151 and an upwardly directed cup-shaped member 210 secured to and rotatable with the head 115. The cup-shaped member has a vertical cylindrical wall 211 with an outwardly turned lip 212 at the upper open end. The rotating cup-shaped member 210 is a centrifugal separator separating the heavier liquids and lighter liquids into concentric layers, the heavier liquids being located further outwardly from the axis of rotation than the lighter liquids as is well known in the art of centrifuges. The separated liquids exit at the top of the centrifuge where a dam or separator 250 directs the separated liquids into respective ones of two annular collector chambers 251 and 252 in a conventional manner, for example, as is disclosed in the aforementioned U.S. Pat. No. 2,921,969. The collector chambers are defined by collars 253 and 254 around the top of the centrifuge and which are secured to a band 255 carried by a top plate 256 of the housing structure 108. Chamber 251 and 252 are provided with respective exit passages or ports designated $P_L$ and $P_H$ for respectively light and heavy liquor.

The mixing volume of mixing chamber 101, hence the film thickness, can be selectively varied by adjusting the vertical position of the head 106, i.e. change the distance between walls 102 and 103. The rate of feed of the liquids to the mixing chamber can be controlled by any suitable means and varied to suit the particular application. The rotational speed of head 115 can also be controlled and selectively varied in any manner so as to have a rate of rotation suitable to the particular application. The size of the dam or deflector 151 can also be appropriately sized to suit the particular application.

Figure 2:
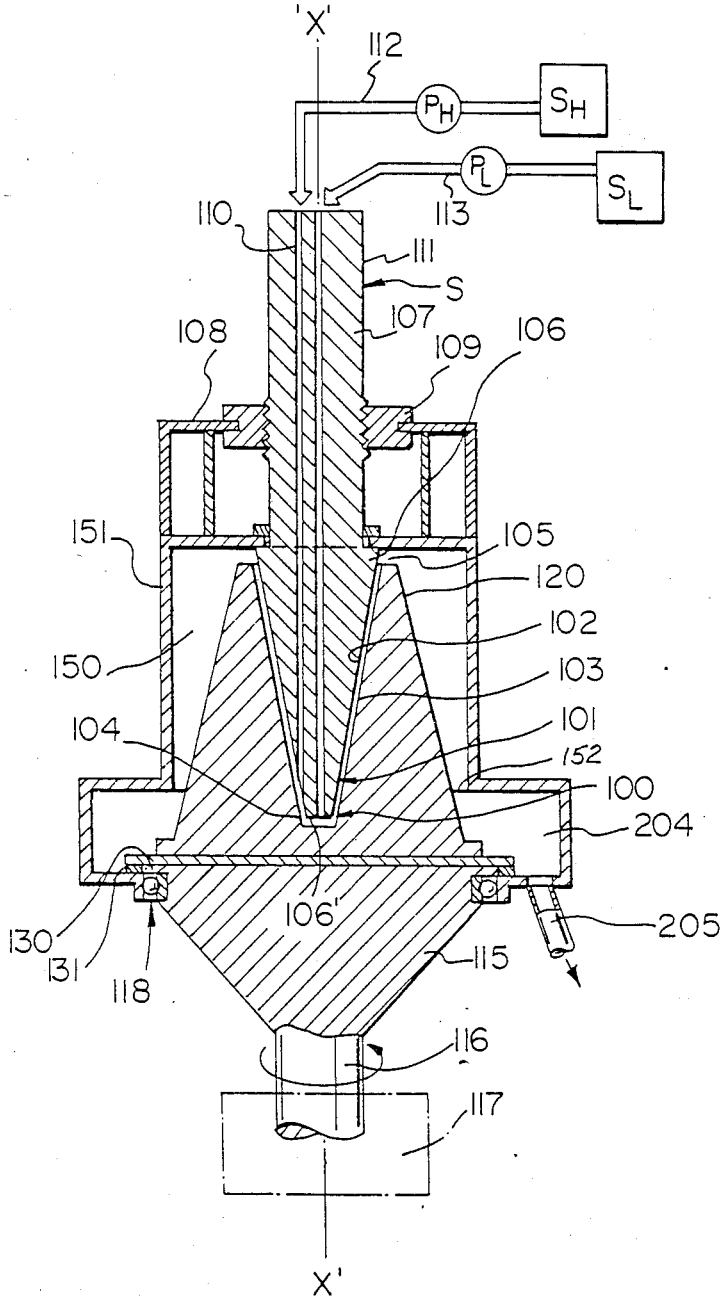
FIG. 2 is a vertical cross-sectional view of a mixer only, similar to the mixer shown in FIG. 1 but illustrating modifications thereto.

The embodiment illustrated in FIG. 1 is a separator and mixer combined into a single unit for use mainly in mixing immiscible units containing reactants and thereafter separating the products of reaction. The mixer, however, also has utility in numerous different areas of technology and the mixer by itself is illustrated in FIG. 2. In this embodiment the liquids mixed in the mixing chamber flow out therefrom through outlet 152 into a collecting chamber 204 from which there is a discharge outlet 205. The chamber 204 is defined by part of the casing structure 108 and thus is stationary relative to the rotatable head 115. This requires that there be a suitable seal between the rotatable head and the casing structure to prevent leakage of liquid from the chamber 204. This, for examaple, may be provided by a rim 130 radiating outwardly from the head 115 and contacting a seal 131 between the rim 130 and the housing structure.

The apparatus illustrated in FIG. 1 and 2 and described in the foregoing, is illustrated in a vertical position with the feed downwardly into the mixing chamber. The mixer, however, can be operated in an inverted position or a horizontal position should such be desired but there would be a slight loss in efficiency.

The mixing chamber 101 is preferably in the shape of a truncated cone as illustrated but could have other geometrical configurations, for example, it may be of constant diameter throughout. The geometrical configuration of the mixing chamber influences the forces which carry the mixture through and out of the chamber. If the mixing chamber is of constant diameter throughout rather than tapered then substantially all of the force required to carry the mixture through and out of the chamber would be supplied by the pumps supplying the components to the mixing chamber. With a mixing chamber having tapered walls there is a centrifugal component in addition to the pump component which forces the mixture through the mixing chamber.

In the preferred form of the mixer illustrated in FIGS. 1 and 2 the spindle head 106 is stationary while the head 115 is rotated. If desired, however, this may be reversed whereby the head 106 is driven to rotate and the head 116 held stationary. Mixing of the components is effectively the same as mixing is dependent upon relative movement of the mixing chamber walls 102 and 103.

The thin film reactor disclosed is essentially a mixer for mixing immiscible liquids and the unit shown in FIG. 1 can be used for liquid-liquid extractions. In the extraction of metals, the same are present in solution as ions which can be complexed with the reagent increasing the metal-complex solubility in a second immiscible solvent (liquid). This solvent can be mixed with the metal solution and separate the metal-complex from the other metals in said solution.

Numerous other variations to this structure will be readily apparent to those skilled in the art, for example, chamber 150 can be variously shaped and one or the other or both of the walls defining the same can be variously modified to effect further mixing and/or designed to assist in moving the mixture through the chamber. For example, wall 120 and/or walls 102, 103 may have ribs extending lonitudinally therealong and-or spirally thereabout. The cross-sectional configuration of the chamber 101 and/or chamber 150 may also be modified if so desired.

Two uses in which the reactor has been tested are noted in the following examples.

EXAMPLE 1

A synthetic leach liquor containing 5 g/L $U_3O_8$ as uranium acetate, Arsenic (4 g/L) as sodium arsenate and molybdenum (0.5 g Mo) as sodium molybdate at a pH=1 was prepared and mixed with kerosene containing 5% triisooctylanium and 3% isooctanol in the thin film reactor. The uranium was extracted from the leach liquor to the kerosene solution. The barren leach liquor contained 0.2 g/L $U_3O_8$. Thus, 94% of the uranium had been extracted from the leach liquor.

EXAMPLE 2

A sample of reformate solution, obtained from a local petroleum refinery, was pumped into the thin film reactor at the rate of 529 mls per minute. Diethylene glycol was added at a rate of 514 mls per minute. The reactor was rotating at 2300 revolutions per minute. Analysis of the treated reformate showed 63% of the aromatics were extracted.

In the foregoing, there is described with reference to FIGS. 1 and 2 a mixer wherein the mixing chamber is annular and in the form of a truncated cone. As such, it has length in the direction of the axis of rotation. An alternative is illustrated in FIG. 3, wherein the mixing chamber extends generally radially in a direction from the axis of rotation in the form of a saw-tooth path. Effectively the saw-tooth path may be considered as a plurality of short in length truncated conical chambers in series one after the other.

Referring particularly to FIG. 3 there is illustrated a mixer 300 which includes a back plate member 301 having an annular cap 302 detachably mounted thereon by a plurality of studs 302A. The annular cap 302 has an inner wall 303 spaced from the back plate 301 providing therebetween a chamber 319. The wall 303 has a plurality of concentric V-shaped grooves 304 circumferentially around the axis designated X—X. The V-shaped grooves are of different radii and effectively separated one from the other by a crest designated 305. As will be apparent, the grooves 304 in the inner face 303 of the cap constitute one wall of the mixing chamber. The other wall of the mixing chamber is on the face portion of a disc-shaped head portion 315 on the end of a shaft 310. The shaft is journalled for rotation about the axis X—X on a pair of bearings 311 and 311A in a bearing housing 312 and such bearing housing is detachably mounted on the back plate 301 by a plurality of studs 313. The bearing 311A has one face thereof abutting a shoulder 314 on the shaft 310, and the other face bears against a compression spring 356.

The end face of head 315 on shaft 310 has a plurality of annular V-shaped grooves 316, such grooves being separated one from the other by crests designated 317. The grooved face of shaft head portion 315 defines the other wall of the mixing chamber. The V-shaped grooves in face 303 and V-shaped grooves in the face of head member 315 are radially offset from one another such that the crest on one face projects into the groove in the other face. Effectively this provides a mixing chamber that has a flat disk-like central portion 318 adjacent the axis of rotation X—X and radially outwardly therefrom consists of a saw-tooth path. This saw-tooth path, in the direction radially outward from the axis X—X, consists of short path portions 318A to 318G, each one of which is effectively an annular chamber having finite length in a direction longitudinally of the axis X—X. The fluid flow path from chamber portion 318 to chamber 319 reverses in direction from one to the next of the annular grooves. For example, the flow path through the annular chamber 318 is to the left as viewed in FIG. 3, while in the next adjacent annular chamber portion 318B the flow path is to the right.

Materials to be mixed are introduced into the mixing chamber through respective inlets 330 and 340. Only two inlets are illustrated, but obviously more inlets can be provided dependent upon the number of materials to be mixed. The materials emerge in their mixed form from the channel portion designated 318G into the chamber 319 and discharge therefrom through an outlet designated 320.

As in the embodiment of FIGS. 1 and 2, the spacing between the walls defining the mixing chamber can be selectively varied. In the embodiment illustrated in FIG. 3, shaft 310 is biased by compression spring 356 in a direction toward the grooved face 303. The shaft 310 is held captive in position by a sleeve 350 that abuts at one end against the bearing 311 and at the other end against a shaft drive pully 353. The shaft drive pulley is secured to the shaft by a locking key 354 and the locking screw 355. An end cap 351 bears against the drive pully and is held onto the shaft by a threaded stud 352. The threaded stud 352 is an adjustment bolt and by turning the same the distance between the grooved face on member 315 is moved toward or away from the face 303.

As will be apparent from the foregoing, the two grooved walls facing one another are movable relative to one another by rotation of the shaft 310 about axis X—X. The grooved walls are also selectively movable toward and away from one another for varying the spacing between the mixing chamber walls, and the mixing chamber itself consists of effectively a plurality of tapered annular chambers of finite elongate length in series with one another radially outwardly from the axis of rotation of the movable member.

As previously mentioned, the mixing apparatus can be used for ceramic particle formation, and also for gas entrainment. The following are applicant's examples of each.

CERAMIC PARTICLE FORMATION

A 0.1 molar solution of aluminum chloride and 0.3 molar sodium hydroxide were fed into the reactor through the separate inlets at 399 mls/min and 328 mls/min respectively.

The moving plate was rotated at 3200 rpm. The spacing between the plates was varied from 2.7 mm to 0.35 mm. At a spacing of 2.7 mm the resulting aluminum hydroxide formed particles approximately 2 μm in diameter. At a spacing of 0.35 mm the particles were less than 1 μm in diameter. Thus particles can be formed of prededetermined size by adjustment of the spacing between the plates. It is also evident due to the formation of smaller particles mixing is efficient at the smaller spacing.

Comparison of particle sizes at two different reactor speeds showed that smaller particles are formed at the higher rates of rotation than at the lower. At 300 rpm and 0.70 mm spacing particles greater than 1 μm were formed and at 3200 rpm particles less than 1 μm were formed.

GAS ENTRAINMENT

The thin film reactor can also be used to entrain a gas in a liquid. Water was introduced into the reactor at 500 ml/min through one inlet and air was introduced through the second inlet. The reactor was rotated at 2000 rpm yielding a white milky product. The solution cleared on standing showing the release of the entrained air. The same technique can be used to intimately contact other reactants notably ferrous iron and ozone to produce ferric solutions and also to chlorinate water.

The centrifugal reactor is a continuous flow device for contacting reactants in miscible and immiscible solvents.

The device consists of two concentric cylinders, cones or discs, one of which is rotated. Reactants are delivered onto inner lower surface; i.e. a narrow portion, centrifugal force forms two thin layers of the immiscible solvents yielding a large area for reaction. As the solvents are centrifuged they travel up the passageway between the two surfaces where the relative motion of the two surfaces set up turbulence resulting in eddy currents, thereby causing mixing. One of the moving elements has a retention zone where the two solvents are gravitationally separated before being collected in separate streams.

Applications of such device are reacting PCB in oils with sodium containing reagents with reclaiming of the oils, or extracting a compound or element from one solution into another.

The embodiments of the invention in which an exclusive property or privilege is claimed are defined as follows:

1. Apparatus for mixing together two or more flowable materials comprising (a) an annular elongate chamber having a central axis and defined by respective first and second wall surfaces radially spaced apart from one another about said axis;

(b) means mounting a structure having one of said wall surfaces thereon permitting movement of such wall surface relative to the other;

(c) material flow passage means for introducing the materials, to be mixed, individually into said chamber adjacent one end thereof; and (d) means permitting discharging the mixture of materials from said chamber adjacent an opposite end thereof, said chamber tapering in a direction from the inlet thereto in a direction toward the outlet therefrom.

2. Apparatus as defined in claim 1 wherein said chamber tapers increasing in diameter in a direction from the inlet thereto toward the outlet therefrom.

3. Apparatus for mixing together two or more flowable materials comprising (a) an annular elongate chamber having a central axis and defined by respective first and second wall surfaces radially spaced apart from one another about said axis;

(b) means mounting a structure having one of said wall surfaces thereon permitting movement of such wall surface relative to the other;

(c) means selectively to vary the distance between said first and second wall surfaces;

(d) material flow passage means for introducing the materials, to be mixed, individually into said chamber adjacent one end thereof; and (e) means permitting discharging the mixture of materials from said chamber adjacent an opposite end thereof.

4. Apparatus for mixing together two or more flowable materials comprising:

(a) an annular elongate chamber having a central axis and defined by respective first and second wall surfaces radially spaced apart from one another about said axis, said first wall being the outer surface of a first conical member and said second wall being the surface of a cavity in a second member and wherein at least one of said first and second members is rotatable about said axis and thereby being movable relative to the other;

(b) means mounting a structure having one of said wall surfaces thereon permitting relative movement of the wall surfaces in a direction longitudinally along said axis to thereby selectively adjust the spacing between said wall surfaces;

(c) material flow passage means for introducing the materials, to be mixed, individually into said chamber adjacent one end thereof; and (d) means permitting discharging the mixture of said materials from said chamber adjacent an opposite end thereof.

5. Apparatus for mixing two or more flexible materials comprising:

(a) an annular elongate chamber having a central axis and defined by respective first and second parallel wall surfaces radially spaced apart from one another about said axis;

(b) means mounting structures having said wall surfaces thereon permitting rotational and axial movement respectively about and along said central axis of one such wall surface relative to the other;

(c) material flow passage means for introducing materials, to be mixed, individually into said chamber adjacent one end thereof;

(d) means permitting discharging the mixture of said materials from said chamber adjacent an opposite end thereof; and (e) a centrifugal separator in fluid flow communication with the mixer and located downstream therefrom with respect to the direction of fluid flow through the mixer.

6. Apparatus as defined in claim 5 wherein said centrifugal separator is disposed coaxially with said annular elongate mixing chamber.

7. Apparatus as defined in claim 6 wherein said centrifugal separator has an elongate separating chamber extending axially along and concentric with said annular elongate mixing chamber.

8. Apparatus for mixing together two or more flowable materials comprising (a) a first annular elongate mixing chamber having a central axis and defined by respective first and second wall surfaces radially spaced apart from one another about said axis;

(b) means mounting a structure having one of said wall surfaces thereon permitting movement of such wall surface relative to the other;

(c) material flow passage means for introducing the materials, to be mixed, individually into said chamber adjacent one end thereof;

(d) means permitting discharging the mixture of said materials from said chamber adjacent an opposite end thereof; and (e) a second annular elongate mixing chamber in material flow relationship downstream from said first mixing chamber, said second mixing chamber being disposed coaxial with said first annular mixing chamber and in concentric relation therewith.

9. Apparatus for mixing together two or more flowable materials comprising:

(a) a tapered annular elongate chamber having a central axis and defined by respective inner and outer wall surfaces closely adjacent but radially spaced apart from one another about said axis;

(b) means mounting structures having said wall surfaces thereon permitting rotational and axial movement of such wall surfaces relative to the other;

(c) material flow passage means for introducing materials, to be mixed, individually into said chamber adjacent one end thereof; and (d) means permitting discharging the mixture of said materials from said chamber adjacent an opposite end thereof.

10. Apparatus as defined in claim 9 wherein said chamber tapers outwardly in a direction from the inlet thereto toward the outlet therefrom.

11. Apparatus as defined in claim 10 wherein the inner wall of the chamber comprises the outer conical surface of a member movable in a direction into and out of a cavity in another member and wherein said other member is journalled for rotation about said central axis.

12. Apparatus as defined in claim 11 wherein said central axis is vertical during operation of the apparatus.

13. Apparatus as defined in claim 9 wherein material flow through said passages is assisted by gravity and wherein flow through said annular chamber is resisted by gravity.

14. Apparatus for mixing two or more fluids comprising:

(a) an annular tapered elongate chamber having a central axis and defined by respective inner and outer opposing wall surfaces radially spaced apart from one another about said axis, said wall surfaces being parallel to one another;

(b) means mounting one of said wall surfaces for movement in a direction axially along said central axis and means mounting the other of said wall surfaces for rotation about said central axis thereby providing axial and rotational movement of the surfaces relative to one another;

(c) fluid flow passage means on the mounting means of said one wall surface for individually introducing the fluids to be mixed into said chamber adjacent one end thereof; and (d) means permitting discharging the mixture of said fluids from said chamber adjacent an opposite end thereof.

15. Apparatus for mixing fluids comprising:

(a) a pair of members having opposing wals facing one another and spaced apart a selected distance to provide a chamber therebetween, said opposing walls surrounding a common axis;

(b) fluid flow passage means having inlets into the chamber for introducing thereinto individually two or more fluids to be mixed;

(c) an outlet from the chamber for discharging therefrom, in continuous flow, a mixture of fluids introduced into the chamber; and (d) means mounting one of said wall surfaces for movement relative to the other by rotation about said common axis, and means mounting the other of said walls for movement toward and away from the said one wall selectively to vary the spacing between such walls in a range of 2.7 mm to 0.35 mm, said inlets to said chamber being closer to the axis of rotation than the outlet from said chamber.

16. Apparatus as defined in claim 15 wherein said outlet is an annular gap extending around said common axis.

17. Apparatus as defined in claim 15 wherein said outlet from the chamber is an annular gap between said spaced apart wall surfaces and wherein said gap is concentric and symmetrically disposed about said common axis.

18. Apparatus as defined in claim 17 wherein said chamber is annular in the form of a truncated cone.

19. Apparatus for mixing together two or more fluids comprising:

(a) a pair of members having opposing walls facing one another and spaced apart a selected distance to provide a mixing chamber therebetween, said opposing walls surrounding a common axis and at least one having a plurality of grooves disposed concentrically in radial spaced relation about said axis;

(b) fluid flow passage means having inlets into the chamber for introducing thereinto individually two or more fluids to be mixed;

(c) an outlet from the chamber for discharging therefrom, in continuous flow, a mixture of fluids introduced into the chamber; and (d) means mounting one of said wall surfaces for movement relative to the other by rotation about said common axis and means movably mounting such other wall for movement toward and away from said one wall adjustably to vary the distance between such walls, said inlets to said chamber being closer to the axis of rotation than the outlet from said chamber.

20. Apparatus as defined in claim 19 wherein said outlet is an annular gap between said opposing walls.

21. Apparatus as defined in claim 19 wherein said opposing wall faces each have a plurality of said concentric grooves and wherein the grooves in one face are radially offset from the grooves in the other face, whereby said mixing chamber comprises a plurality of annular tapered chamber portions in series in a direction radiating out from said common axis.

22. Apparatus as defined in claim 19 wherein said grooves are V-shaped.

23. Apparatus for mixing together two or more fluids comprising:

(a) a pair of members having opposing walls facing one another and spaced apart a selected distance to provide a mixing chamber therebetween, said opposing walls being disposed transverse to a common axis and each having a plurality of grooves disposed concentrically in radial spaced relation about said common axis, said grooves in one face being radially offset from adjacent corresponding grooves in the other face and thereby providing in series a plurality of tapered annular mixing chamber portions;

(b) fluid flow passage means having inlets into said mixing chamber for introducing thereinto individually two or more fluids to be mixed;

(c) an outlet from the chamber for discharging therefrom, in continuous flow, a mixture of fluids introduced into the chamber; and (d) means mounting one of said wall surfaces for movement relative to the other by rotation about said common axis and means movably mounting such other wall for movement toward and away from said one wall adjustably to vary the distance therebetween in a range of from 2.7 mm to 0.35 mm, said inlets to said chamber being closer to the axis of rotation than the outlet from said chamber.

24. Apparatus for mixing together two or more fluids comprising:

(a) a mixing chamber defined by respective first and second spaced apart wall surfaces each symmetrically disposed about a common axis;

(b) means mounting a structure having one of said wall surfaces thereon permitting selective adjustment movement of said wall surface in a direction toward and away from the other to selectively vary the spacing between said walls;

(c) fluid flow passage means having inlets into said chamber for introducing thereinto individually two or more fluids to be mixed;

(d) one or more outlets from the chamber for discharging therefrom a mixture of the fluids introduced into the chamber; and (e) means mounting at least one of said wall surfaces for rotation about said common axis thereby providing for movement of one of said first and second wall surfaces relative to the other to effect mixing of fluids disposed therebetween.

25. Apparatus as defined in claim 24 wherein said mixing chamber is defined by the outer surface of a first cylindrical member and a conical cavity in a second member.

26. Apparatus as defined in claim 24 wherein said mixing chamber is defined by the outer surface of a first conical member and a cylindrical cavity in a second member.

27. Apparatus as defined in claim 24 wherein said mixing chamber is defined by the outer surface of a first conical member and a conical cavity in a second member.

28. Apparatus as defined in claim 24 wherein said mixing chamber is defined by a pair of members having opposing surfaces facing one another and spaced apart a selected distance to provide a chamber therebetween, said opposing walls being perpendicular to said common axis and each having a plurality of grooves concentrically disposed about said axis.

29. Apparatus as defined in claim 24 wherein the inner and outer wall surfaces forming said mixing chamber have separate parallel axes.

* * * * *